US005780196A

United States Patent [19]

Fujiwara et al.

[11] Patent Number: 5,780,196

[45] Date of Patent: Jul. 14, 1998

[54] TONER AND LIQUID DEVELOPER, LIQUID DEVELOPER, AND METHOD OF PRODUCING SAME

[75] Inventors: Toshimitsu Fujiwara, Kobe; Shuji Iino, Muko; Masaharu Kanazawa, Suita; Seishi Ojima; Hidetoshi Miyamoto, both of Takatsuki, all of Japan

[73] Assignee: Minolta Co., Ltd., Osaka, Japan

[21] Appl. No.: 780,017

[22] Filed: Dec. 23, 1996

[30] Foreign Application Priority Data

Dec. 27, 1995 [JP] Japan ..... 7-341480

[51] Int. Cl.[6] ..... G03G 9/087

[52] U.S. Cl. ..... 430/137; 430/114

[58] Field of Search ..... 430/114, 137

[56] References Cited

U.S. PATENT DOCUMENTS

| | | | |
|---|---|---|---|
| 4,760,009 | 7/1988 | Larson | 430/114 |
| 4,794,651 | 12/1988 | Landa et al. | 430/114 |
| 4,923,778 | 5/1990 | Blair et al. | 430/137 |
| 5,047,307 | 9/1991 | Landa et al. | 430/137 |
| 5,192,638 | 3/1993 | Landa et al. | 430/137 |
| 5,565,299 | 10/1996 | Gibson et al. | 430/137 |

FOREIGN PATENT DOCUMENTS

| | | | |
|---|---|---|---|
| 58-129438 | 8/1983 | Japan | 430/137 |
| 58-168055 | 10/1983 | Japan | 430/137 |

*Primary Examiner*—Roland Martin
*Attorney, Agent, or Firm*—McDermott, Will & Emery

[57] ABSTRACT

A method for producing a liquid developer comprising steps of:

adding a colored resin to a nonpolar dispersion medium;

elevating the temperature of said nonpolar dispersion medium above the melting point of said resin;

producing a resin emulsion by mixing said heated nonpolar dispersion medium containing said resin therein; and cooling said resin emulsion so as to obtain colored resin microparticles.

15 Claims, 2 Drawing Sheets

TONER AND LIQUID DEVELOPER, LIQUID DEVELOPER, AND METHOD OF PRODUCING SAME

BACKGROUND OF THE INVENTION

1. Field of the Invention

The present invention relates to a toner for liquid developer and liquid developer for use with image forming apparatuses of the electrophotographic type. Furthermore, the present invention relates to method of producing toner for liquid developer and method of producing liquid developer for use with image forming apparatuses of the electrophotographic type.

2. Description of the Related Art

Electrophotographic methods of image formation for using a charged toner to develop an electrostatic latent image formed on the surface of a latent image carrying member such as a photosensitive member or the like can be broadly divided into dry developing methods which directly use a powder toner, and wet developing methods which use a liquid developer comprising a toner dispersed in a liquid medium.

Among the aforementioned methods, wet type developing methods develop an electrostatic latent image formed on a photosensitive surface via contact of a liquid developer on the photosensitive surface. Typically, wet type developing methods are advantageous with respect to high image quality because the toner used has a smaller particle size than the toner used in dry type developing methods.

Generally, a toner image formed on the surface of an image carrying member is electrostatically transferred onto a recording member such as a paper sheet or the like, and subsequently fixed thereon to form a recorded image, but it is important to regulate the particle size of toner contained in a liquid developer within a suitable range to achieve satisfactory transfer of the toner image. In particular, the quest for plain paper image formation and color image formation by overlaying toner images of various colors in recent years has required excellent transfer characteristics. Thus, it is very important to regulate the toner particle size within a suitable range.

Investigations by the present inventors disclosed, for example, that developing speed and transfer characteristics can be improved by setting the volume average particle size ($d_{50}$) of color particles used in liquid developer at about 1.5 to 5.0 μm, and high luster images can be obtained which cannot be produced by dry type developing methods.

Suitable methods for granulation methods and raw material pulverization methods are necessary to manufacture toner for liquid developer having the aforementioned particle size. Heretofore, toner manufacturing methods for liquid developers have not satisfied all requirements of characteristics as liquid developers, simplicity of the manufacturing method, cost and the like.

For example, Japanese Laid-Open Patent Application No. HEI 5-87825 discloses a method of manufacturing toner for a wet developer via in-liquid pulverization to render the resin dispersed in a dispersion medium via the application of a shearing force on the dispersion medium. In the method disclosed in this publication, however, the physical characteristics of the binder resin comprised of particles is severely restricted, and is therefore disadvantageous inasmuch as the freedom of the design of the developer is quite narrow. Specifically, although ELVAZ (ethylene copolymer), ELVACITE (methacrylate resin) and the like manufactured by E.I. Dupont de Nemours & Company are described in the aforementioned Japanese publication, these resins have specific properties such as being insoluble in dispersion medium at temperatures below 40° C., being soluble in dispersion medium at temperatures of 50° C. and higher, and melting at 70° C. When using such resins which are soluble in dispersion medium at temperatures of 50° C. and higher, there is concern that when the environmental temperature rises within the developing device, or when the temperature rises during storage or transport, the resin may dissolve out of the dispersion medium so as to alter the characteristics of the developer.

Japanese Unexamined Patent Application No. SHO 51-89428 discloses an in-liquid pulverization method for producing particles in liquid, wherein resin materials are mixed in a liquid with media such as glass beads or the like so as to pulverize the resin material via impact with the glass beads to produce liquid developer. Specifically, in the aforementioned publication, a linear polyester resin such as crystalline poly(decamethylene sebacate) or the like is mixed with pigment, and subsequently this resin is pulverized in a dispersion medium (Isoper G; Exxon, Inc.) using a ball mill to produce colored microparticles having a mean particle size of about 2 μm. This method is disadvantageous not only for severe restriction of resin selection, but also because it lengthens the pulverization time and produces a broad particle size distribution of the resulting particles. In liquid developing methods in particular, large particle size toner has a faster migration speed and tends to be consumed first during development, such that when the toner particle size distribution is broad, the characteristics of the developer change as development continues, and causes concern that images identical to the initial images cannot be obtained under the initially set developing conditions.

Methods for producing toner for use in dry type developing methods include well known dry type pulverization methods using a jet mill and the like. For example, Japanese Unexamined Patent Application No. SHO 48-95842 discloses a method wherein coarse clumps of resin are pulverized using a jet mill, and subsequently dispersed in a dispersion medium to produce a liquid developer. Dry type pulverization methods such as the method described above are disadvantageous inasmuch as it is extremely difficult to obtain a satisfactory yield of small particle size resin particles, and such methods produce a broad particle size distribution similar to that of wet type pulverization methods.

On the other hand, methods of granulating resin particles in polar solvent medium such as water or the like without utilizing a pulverization process have been proposed, including wet type granulation methods such as emulsion dispersion granulation, emulsion polymerization, suspension polymerization, nonaqueous dispersion polymerization, seed polymerization and the like. For example, Japanese Unexamined Patent Application No. HEI 6-222613 discloses an emulsion dispersion granulation method wherein a polymer is dissolved in an organic solvent medium which is insoluble in water, and this solution is subjected to emulsion dispersion in an aqueous dispersion liquid to produce an oil-in-water (O/W) type emulsion which is then mixed and heated to evaporate the organic solvent, and polymer particles having a mean particle size of 1 to 10 μm is extruded from the solution. Although the emulsion dispersion granulation method disclosed in the aforementioned publication is satisfactory in terms of breadth of resin selectivity and sharpness of the particle size distribution, a desolvation process is required to extract the resin particles, and which is disadvantageous in terms of the simplicity of the production process, production time, and cost. Heretofore, in methods for producing toner for liquid developer via the aforementioned proposed wet type granulation methods, additives such as surface active agent polymerization initiators, dispersion stabilizers and the like are required in the processing, such that small amounts of said additives remain in the liquid despite adequate washing and unavoidably adhere to the surface of the resin particles. The liquid developer using resin particles to the surface of which is adhered the aforementioned additives possesses unstable charging characteristics, and there is concern that the amount of inadequately charged toner or the amount of oppositely charged toner will increase thereby. In the aforementioned wet type granulation methods, a process is required to separate the particles from the dispersion medium in order to eliminate the surface active agent remaining in the aqueous dispersion medium, but such separation by toner sedimentation is extremely difficult and increases the time required for the process of separating the toner particles.

SUMMARY OF THE INVENTION

An object of the present invention is to provide a toner for liquid developer having a sharp particle size distribution, stable charging characteristics, and excellent developing characteristics.

Another object of the present invention is to provide a liquid developer with toner having a sharp particle size distribution, stable charging characteristics, and excellent developing characteristics.

Still another object of the present invention is to provide a method for producing a toner for liquid developer and a method for producing liquid developer capable of producing toner for liquid developer and liquid developer simply and in a short period.

The aforementioned objects are achieved by the method for producing liquid developer of the present invention comprising a step of adding a colored resin to a nonpolar dispersion medium, a step of elevating the temperature of said nonpolar dispersion medium above the melting point of said resin, a step of producing a resin emulsion by mixing said heated nonpolar dispersion medium to which said resin has been added, a step of solidifying colored resin microparticles by cooling said resin emulsion.

The aforementioned objects are achieved by the liquid developer of the present invention produced by a step of adding a colored resin to a nonpolar dispersion medium, a step of elevating the temperature of said nonpolar dispersion medium above the melting point of said resin, a step of producing a resin emulsion by mixing said heated nonpolar dispersion medium to which said resin has been added, a step of solidifying colored resin microparticles by cooling said resin emulsion.

The aforementioned objects are achieved by the method for producing a toner for liquid developer of the present invention comprising a step of adding a colored resin to a nonpolar dispersion medium, a step of elevating the temperature of said nonpolar dispersion medium above the melting point of said resin, a step of producing a resin emulsion by mixing said heated nonpolar dispersion medium to which said resin has been added, a step of solidifying colored resin microparticles by cooling said resin emulsion.

The aforementioned objects are achieved by the toner for liquid developer of the present invention produced by a step of adding a colored resin to a nonpolar dispersion medium, a step of elevating the temperature of said nonpolar dispersion medium above the melting point of said resin, a step of producing a resin emulsion by mixing said heated nonpolar dispersion medium to which said resin has been added, a step of solidifying colored resin microparticles by cooling said resin emulsion.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

Figure 1:
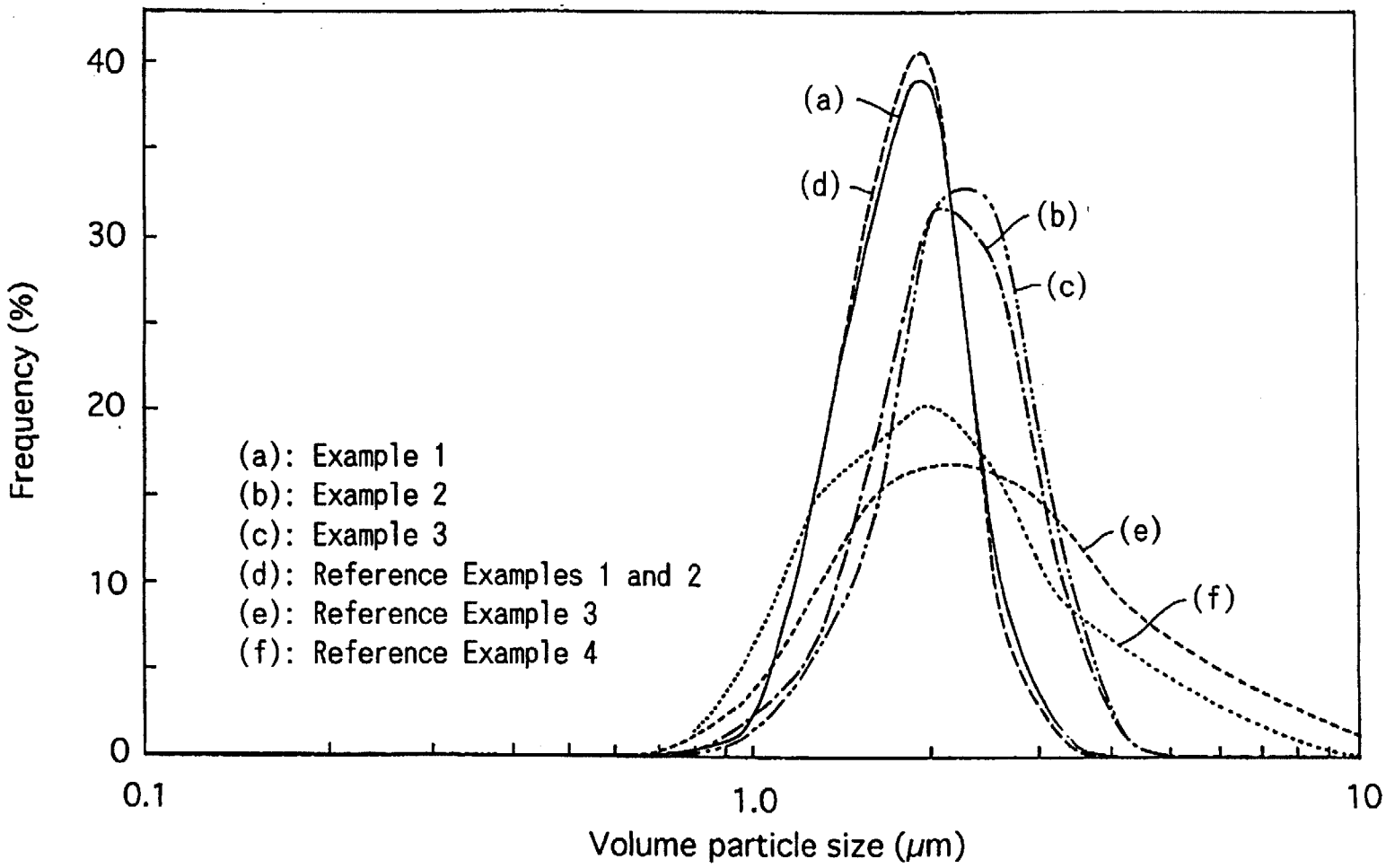
FIG. 1 illustrates the particle size distribution of resin microparticles in the liquid developer.

The preferred embodiments of the present invention are described hereinafter.

Resins for forming the resin microparticles of the toner are not specifically limited insofar as such resins possess a softening point and reduced viscosity due to the temperature elevation. Examples of useful resins include polyester resin, styrene-acrylic copolymer, polystyrene, polyvinylchloride, polyvinyl acetate, polymethacrylate ester, polyacrylate ester, epoxy resin, polyethylene, polyurethane, polyamide, paraffin wax and the like used individually or in blends thereof. Polyester resins are particularly desirable from the perspective of light transmittancy and toughness.

Pigments or dyes such as carbon black, phthalocyanine and the like may be dispersed or dissolved in the aforementioned resins as colorants, or colored resins may be used. The amount of colorant added to the resin is desirably within a range of 5 to 20 parts-by-weight relative to 100 parts-by-weight of resin.

The colorant may be, for example, dispersed/dissolved in the resin by fusion kneading at about 150° to 200° C. using a dual roller kneading device or the like.

An electrically insulative organic compound is desirable for use as a nonpolar dispersion medium. Examples of such useful materials include aliphatic hydrocarbon, alicyclic hydrocarbons, halogenated hydrocarbons, polysiloxane and the like. Isoparaffin solvents are particularly desirable from the perspectives of nontoxicity, odor, and cost. Specific examples of useful materials include Isoper G, Isoper H, Isoper L, Isoper K (all products of Esso, Inc.), Shelsol 71 (Shell Oil Chemicals), IP solvent 1620, IP solvent 2028 (all products of Idemitsu Sekiyu Kagaku, K. K.).

Since the nonpolar dispersion medium need not be a liquid at room temperature if said medium is a liquid when the temperature is elevated above the softening point of the dispersed resin, it is possible to use waxes, paraffins and the like which are solids at room temperature. When using such waxes or paraffins which are solids at room temperature, it is desirable to return the material to a liquid state via heating prior to use as a liquid developer.

The boiling point of the nonpolar dispersion medium is desirably higher than the softening point of the dispersed resin from the perspectives of ease of production and yield.

These dispersion media may be general dispersion fluids used in liquid developers. Accordingly, the dispersion medium used in the production of the liquid developer may be used directly, or more desirably, can be used to prevent spoiling the developing characteristics of a liquid developer when using substantially homologous components as dispersion media of an ultimate liquid developer.

Oil soluble surfactants may be added to the nonpolar dispersion medium. Material formed by dissolving resin in a nonpolar dispersion medium or emulsifying a resin and dispersion medium may be used as an oil soluble surfactant. Particularly when a dispersion medium used in the manufacturing process is used directly as the dispersion fluid of the ultimately obtained liquid developer, it is desirable that the material exert no influence on the chargeability of the liquid developer, or function as a charge controller, and dispersion agents and charge controllers and the like generally used in liquid developers may be used as oil soluble surfactants.

Specific examples of useful oil soluble surfactants include copolymers of lipophilic long-chain (meth)acrylate and hydrophilic polar monomer.

Specific examples of long-chain lipophilic (meth) acrylates include hexyl(meth)acrylate, cyclohexyl(meth) acrylate, 2-ethylhexyl(meth)acrylate, nonyl(meth)acrylate, decyl(meth)acrylate, lauryl(meth)acrylate, stearyl(meth) acrylate.

Specific examples of polar monomers include monomers having a carboxyl group such as (meth)acrylic acid, itaconic acid, maleic acid, vinyl acetate, vinyl glycogen, vinyl acrylate, vinyl benzoate and the like, and metal salts thereof (e.g., metal salts such as Li, Na, K, Ca, Mg, Al and the like), monomers having a sulfone group or sulfine group such as vinyl sulfonate, vinylbenzene sulfonate, vinylbenzyl sulfonate, vinylbenzene sulfinate and the like, and metal salts thereof (monomers having a phosphate group and metal salts thereof, and nitrogen containing monomers expressed in section (A) through (F) below:

(A) (meth)acrylates having an aliphatic amino group such as N,N-dimethylaminoethyl(meth)acrylate, N,N-diethylaminoethyl (meth)acrylate, N,N-dibutylaminoethyl(meth)acrylate, N,N-hydroxyethylaminoethyl(meth)acrylate, N-benzyl, N-ethylamino(meth)acrylate and the like;

(B) nitrogen-containing complex ring vinyl monomers such as N-vinylimidazole, N-vinylindazole, 2-vinylpyridine, 4-vinylpyridine, 2-vinylquinoline, 4-vinylquinoline, 2-vinyloxazole and the like;

(C) N-vinyl substituted ring amide monomers such as N-vinylpyrrolidone, N-vinylpiperidone and the like;

(D) (meth)acrylamides such as N-methylacrylamide, N-octylacrylamide, N-phenylmethylacrylamide, N-cyclohexylacrylamide, acrylpiperidine, acrylmorpholine and the like;

(E) aromatic substituted ethylene monomers such as having a nitrogen containing group such as dimethylaminostyrene, diethylainostyrene, dioctylaminostyrene and the like; and (F) nitrogen containing vinyl ether monomers such as vinyl-N-ethyl-N-phenylaminoethyl ether, triethanolamine divinyl ether, vinylpyrrolidylamino ether and the like.

The aforementioned lipophilic long-chain (meth)acrylates and polar monomers may be used individually or in combinations of two or more.

In copolymers formed by the aforementioned lipophilic long-chain (meth)acrylates and polar monomers, the constituent ratio of the polar monomer is desirably 0.1 to 30 percent-by-weight, and preferably 0.5 to 20 percent-by-weight, relative to the total monomer weight.

Further examples of materials useful as an oil soluble surfactant include metal salts of fatty acids such as naphthenic acid, octenic acid, oleic acid, stearyl acid and the like, metal salts of sulfosuccinic acid ester, metal salts of alkylsulfonic acid, metal salts of phosphoric acid ester, metal salts of abietic acid or hydrogen added abietic acid, metal salts of alkylbenzene calcium sulfonate, aromatic carboxylic acid or sulfonic acid, nonionic surfactant such as polyoxyethyl alkylamine, lecithin, fatty oils such as linseed oil and the like, organic acid ester of polyvalent alcohol, phosphate surfactant, sulfonic acid resin and the like. These materials may be used individually or in combinations of two or more.

The content amount of oil soluble surfactant in the nonpolar dispersion medium is desirably 0.5 to 40 percent-by-weight, and preferably 1 to 20 percent-by-weight. This amount corresponds to an amount of about 1/20 to 1 part of the weight of the resin component dispersed in the nonpolar dispersion medium. When the surfactant content is less than 0.5 percent-by-weight, there is concern that adequate emulsification will not be attained. When the oil soluble surfactant content exceeds 40 percent-by-weight, the electrical resistance of the dispersion medium is excessively reduced, thereby rendering the material unsuitable for use as a liquid developer.

In addition, other additives such as charge controller, dispersion agent, stabilizer and the like may be added as necessary.

Although the resin added to the nonpolar dispersion medium during processing is not specifically limited, it is desirable that the resin is heated above its softening point so as to attain a molten state prior to the process described above. The amount of resin added to the nonpolar dispersion medium is desirably 3 to 50 parts-by-weight, and preferably 10 to 40 parts-by-weight, relative to 100 parts-by-weight of nonpolar dispersion medium. In the present specification, the resin softening point was measured under conditions of 30 kgf load and temperature elevation speed of 3° C./min using a flow tester (Shimadzu Seisakusho, K. K.)

There are no particular restrictions in the temperature elevation process of the nonpolar dispersion medium, and the material may be heated to a temperature above the softening point of the resin added to the nonpolar dispersion medium via an optional heating means. Specifically, the liquid temperature of the nonpolar dispersion medium may be set at 80° to 200° C. A mantle heater, oil bath or the like may be used as the heating means. The nonpolar dispersion medium may be preheated before the addition of the resin, or may be maintained above the resin softening point for a predetermined time after the addition of the resin.

In the process of dispersing the resin solute in the dispersion medium using a mixing means to form a resin emulsion, it is specifically desirable to use a high shear force mixing device such as a homogenizing mixer as the mixing means. The particle diameter of the resin droplets can be controlled by adjusting the mixing speed of the mixing device. Although the mixing speed of the mixing device may be optionally set in accordance with a desired particle diameter, a mixing speed in the range of about 5,000 to 15,000 rpm is desirable. A mixing time of 10 minutes or longer is desirable. When the mixing time is less than 10 minutes, there is concern that a sharp particle size distribution may not be obtained. Besides adjusting the mixing speed to control the particle size of the resin droplets, methods may be used to change the viscosity of the resin by selecting types of resin to be used and changing the oil temperature.

To improve dispersability of the resin droplets when the oil soluble surfactant is added as previously described, the oil soluble surfactant may be added prior to the formation of the resin emulsion via mixing, and preferably the surfactant will be added and mixed in the nonpolar dispersion medium beforehand. In particular, material which itself has a charge controller, or material functioning as a dispersing agent for the resin particles in the liquid developer are desirable for selection as the oil soluble surfactant.

In the process of cooling the resin emulsion, a suspension of colored resin particles dispersion in the dispersion medium can be obtained by solidifying the dissolved resin using an optional cooling means. Methods for rapidly cooling while mixing are desirable for use as the emulsion cooling means to prevent particle flocculation and adhesion. When natural cooling is used, cooling while mixing thoroughly may be used in view of possible particle flocculation. When an oil soluble surfactant is added to a dispersion medium, the dispersing agent on the surface of the colored resin particles is subject to micelle formation which is absorbed in suspension. Accordingly, when the material selected as an oil soluble surfactant functions as a charge controller or dispersing agent, it may be used directly as a liquid developer or in a state of dilution by dispersion medium of identical components or dispersion medium fluid having chemically similar properties and components used as a liquid developer.

After granulation, the toner particles may be separated from the dispersion medium, and used as the toner for a liquid developer via drying as necessary. In this instance, it is desirable to use a fluid dispersion medium which has the same components or chemically similar properties and components as the dispersion medium used in the manufacturing process in the dispersion medium used with the toner.

Specific examples of the present invention are described in detail hereinafter.

Example 1

To 100 parts-by-weight polyester resin having an acid value of 45, glass transition point (Tg) of 45.8° C., softening point (Tm) of 77.9° C., and weight-average molecular weight (Mw) of 4600 were added 10 parts-by-weight of carbon black (Mogal L; Cabot, Inc.), and the mixture was fusion kneaded for about 4 hr at 180° C. using a dual roller kneader to obtain a kneaded resin material. This kneaded resin material became the molten resin material when maintained in a molten state.

Then, laurylmethacrylate (LMA) and vinylpyrrolidone (VP) copolymer (LMA/VP=95/5; Mw:200,000) was dissolved in IP Solvent 2028 (Idemitsu Sekiyu Kagaku K. K.; initial boiling point: 213° C.) to achieve 5 percent-by-weight relative to the solvent so as to obtain a liquid dispersion medium.

This liquid dispersion medium was heated and maintained at 180° C., and 20 parts-by-weight of the aforementioned molten resin material was added to 100 parts-by-weight of said heated liquid dispersion medium, and mixed via a homogenizing mixer (Tokushu Kika Kogyo K. K.) to produce an emulsion dispersion. The speed of the homogenizing mixer was set at 8,000 rpm, and the processing was performed for 20 minutes. The molten resin material dispersed in the liquid dispersion medium was thus emulsified.

Then, the mixing blade of the homogenizing mixer was replaced with a four-blade mixing blade and mixing of the emulsion continued as the emulsion was rapidly cooled to solidify the resin particles so as to produce a resin particle suspension fluid.

The obtained resin particle suspension fluid was diluted 6-fold using IP solvent 2028 (Idemitsu Sekiyu Kagaku K. K.), and the material was subjected to a mixing/dispersion process for 20 min using an ultrasonic dispersion mixer to produce liquid developer 1.

Example 2

A molten resin material was obtained using the same sequence as described in Example 1. Then, laurylmethacrylate (LMA) and methacrylic acid (MAA) copolymer (LMA/MAA=95/5; Mw:180,000) used as an oil soluble surfactant was dissolved in IP Solvent 2028 (Idemitsu Sekiyu Kagaku K. K.; initial boiling point: 213° C.) used as a nonpolar dispersion medium to achieve 5 percent-by-weight relative to the solvent so as to obtain a liquid dispersion medium.

This liquid dispersion medium was heated and maintained at 130° C., and 20 parts-by-weight of the aforementioned molten resin material was added to 100 parts-by-weight of the heated liquid dispersion medium, and mixed via a homogenizing mixer (Tokushu Kika Kogyo K. K.) to produce an emulsion dispersion. The speed of the homogenizing mixer was set at 8,000 rpm, and the processing was performed for 20 minutes. The molten resin material dispersed in the liquid dispersion medium was thus emulsified.

Then, the mixing blade of the homogenizing mixer was replaced with a four-blade mixing blade and mixing of the emulsion continued as the emulsion was rapidly cooled to solidify the resin particles so as to produce a resin particle suspension fluid.

The obtained resin particle suspension fluid was diluted 6-fold using IP solvent 2028 (Idemitsu Sekiyu Kagaku K. K.), lecithin was added as a charge controller to 0.5 percent-by-weight relative to the total weight of the liquid, and the material was subjected to a mixing/dispersion process for 20 min using an ultrasonic dispersion mixer to produce liquid developer 2.

EXAMPLE 3

A resin particle suspension comprising resin particles dispersed in a dispersion medium was prepared in the same sequence as Example 1 with the exception that a polyester resin having an acid value of 2.5, glass transition point (Tg) of 64.0° C., softening point (Tm) of 100.1° C., and weight-average molecular weight (Mw) of 9,400 was substituted for the polyester resin used in Example 1.

The obtained resin particle suspension was diluted 6-fold using IP solvent 2028 (Idemitsu Sekiyu Kagaku K. K.), and the material was subjected to a mixing/dispersion process for 20 min using an ultrasonic dispersion mixer to produce liquid developer 3.

Reference Example 1

A polyester resin identical to that of Example 1 was completely dissolved in methylene chloride to achieve a resin content of 20 percent-by-weight, then carbon black was added at a ratio of 10 parts-by-weight carbon black (Mogal L; Cabot, Inc.) per 100 parts-by-weight resin, and the material was dispersed in solution by mixing using an Eiger motor mill (Eiger Japan, Ltd.).

The obtained resin solution was added to an aqueous dispersion fluid comprising 1 percent-by-weight Metrose 65SH-50 (Shinetsu Kagaku Kogyo K. K.) used as an aqueous dispersion agent and 0.1 percent-by-weight sodium lauryl sulfate, and mixed using a homogenizing mixer (Tokushu Kika Kogyo K. K.) to obtain an O/W emulsion. The speed of the homogenizing mixer was 8,000 rpm, and the processing time was 20 min at room temperature.

Then, the mixing blade of the homogenizing mixer was replaced with a four-blade mixing blade, the aforementioned emulsion was maintained at a temperature of 40°to 45° C. and mixed for 3 hr to remove the methylene chloride and obtain an aqueous resin particle suspension comprising resin particles dispersed in an aqueous solution.

The obtained aqueous resin particle suspension centrifuged in a centrifuge separator to remove the solids, which were then dried to produce resin particles for use as toner.

These toner resin particles were added at a rate of 3 parts-by-weight into a solution comprising 0.5 parts-by-weight lauryl methacrylate (LMA) and vinyl pyrrolidone (VP) copolymer (LMA/VP=95/5; Mx:200,000) dissolved in 100 parts IP solvent 2028 (Idemitsu Sekiyu Kagaku K. K.; initial boiling point: 213° C.), and subjected to dispersion mixing for 20 min using an ultrasonic dispersion device to obtain liquid developer 4.

REFERENCE EXAMPLE 2

An aqueous resin particle suspension of dispersed resin particles was produced in the same sequence as described in Reference example 1. The solids were removed from the obtained aqueous resin particle suspension using a centrifuge separator, and the removed solids were washed overnight in running water, then filtered and dried to obtain resin particles for use as toner.

These toner resin particles were added at a rate of 3 parts-by-weight into a solution comprising 0.5 parts-by-weight lauryl methacrylate (LMA) and vinyl pyrrolidone (VP) copolymer (LMA/VP=95/5; Mx:200,000) dissolved in 100 parts IP solvent 2028 (Idemitsu Sekiyu Kagaku K. K.; initial boiling point: 213° C.), and subjected to dispersion mixing for 20 min using an ultrasonic dispersion device to obtain liquid developer 5.

Reference Example 3

A kneaded resin material was produced in the same sequence as described in Example 1. After this kneaded resin material was cooled, it was coarsely pulverized to about 1 mm diameter particles using a cutter mill.

The coarsely pulverized material was then finely pulverized using a jet mill (Japan Pneumatic, Ltd.) to obtain resin particles for use as toner. The pulverization at this time was performed under conditions of air pressure of 3.5 kg/cm$^2$, and a feed rate set at 1 kg/hour.

These toner resin particles were added at a rate of 3 parts-by-weight into a solution comprising 0.5 parts-by-weight lauryl methacrylate (LMA) and vinyl pyrrolidone (VP) copolymer (LMA/VP=95/5; Mx:200,000) dissolved in 100 parts IP solvent 2028 (Idemitsu Sekiyu Kagaku K. K.; initial boiling point: 213° C.), and subjected to dispersion mixing for 20 min using an ultrasonic dispersion device to obtain liquid developer 6.

Reference Example 4

A kneaded resin material was produced in the same sequence as described in Example 1. After this kneaded resin material was cooled, it was coarsely pulverized to about 1 mm diameter particles using a cutter mill.

These toner resin particles were mixed at a rate of 30 parts-by-weight with 5 parts-by-weight lauryl methacrylate (LMA) and vinyl pyrrolidone (VP) copolymer (LMA/VP=95/5; Mx:200,000) dissolved in 100 parts IP solvent 2028 (Idemitsu Sekiyu Kagaku K. K.; initial boiling point: 213° C.), then subjected to wet type fine pulverization using a sand grinder mill using 1 mm diameter glass beads as the medium to obtain a dense liquid comprising resin particles dispersed in dispersion medium. The wet type pulverization was accomplished at 2,000 rpm and a processing time of 10 hours.

The obtained dense liquid was diluted 10-fold using IP solvent 2028 (Idemitsu Sekiyu Kagaku K. K.), then subjected to mixing dispersion for 20 min using an ultrasonic dispersion device to obtain liquid developer 7.

EVALUATIONS (1) Particle Size Distribution

The mean particle size and particle size distribution of resin particles dispersed in the liquid developer was measured using a model SALD-1100 (Shimadzu Seisakusho K. K.). The particle size distributions are shown in FIG. 1, and the mean particle size is shown in Table 1.

It can be understood from FIG. 1 that the particles of Examples 1, 2, and 3, and Reference Examples 1 and 2 produced by the wet type granulation method have sharp particle size distribution, whereas the particles of Reference Examples 3 and 4 produced by the pulverization method had broad particle size distributions.

(2) Image Experiments

Figure 2:
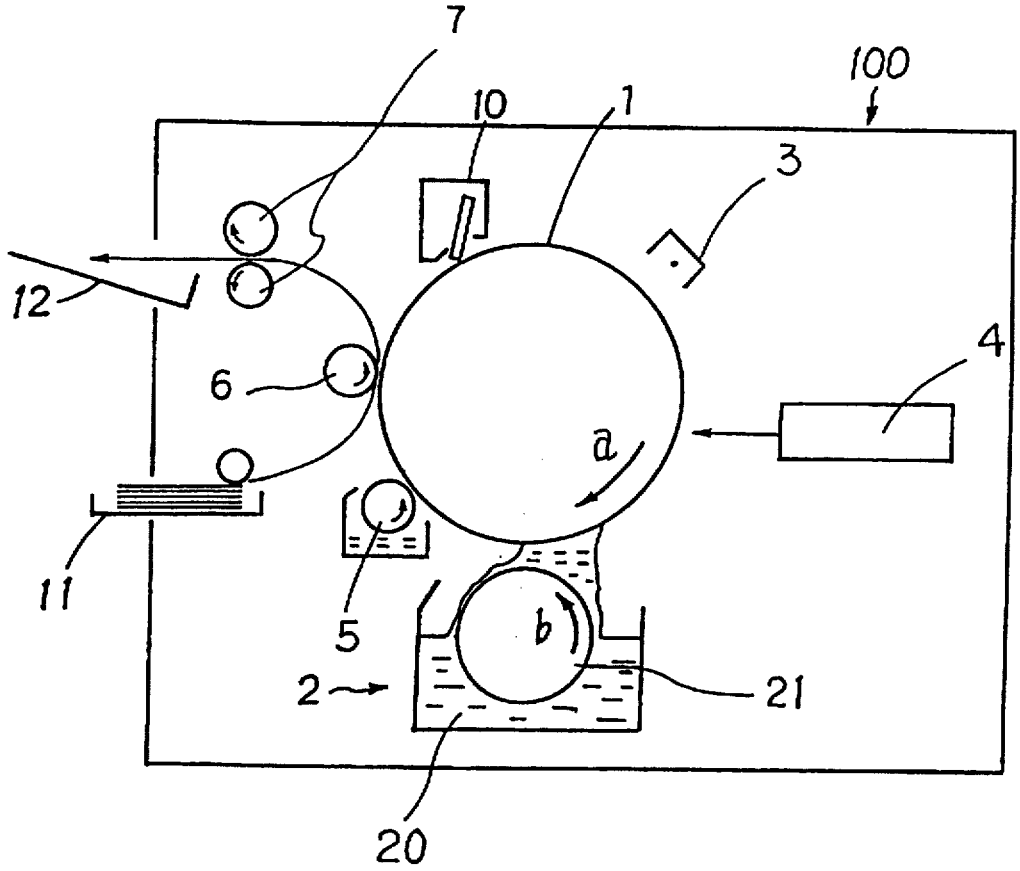
FIG. 2 shows an image forming apparatus used in image experiments.

Image experiments were conducted using each of the liquid developers loaded in the image forming apparatus shown in FIG. 2. The construction, operation and image forming conditions of the aforementioned image forming apparatus are described below.

As shown in FIG. 2, image forming apparatus 100 is an electrophotographic type apparatus provided with a photosensitive drum 1, and arranged sequentially around said photosensitive drum 1 are a scorotron charger 3, laser beam scanner 4, developing unit 2 comprising a developer tank 20 accommodating liquid developer and a developing roller 21 the bottom portion of which is impregnated with liquid developer and confronts photosensitive drum 1 with a small gap therebetween, squeeze device 5, transfer roller 6, and cleaning device 10. Provided in the vicinity of transfer roller 6 are paper supply device 11 and heat fixing roller pair 7.

During image formation, photosensitive drum 1 rotates in the arrow a direction in the drawing, and the surface of the photosensitive drum 1 is uniformly charged to a potential of about −1,000 V by scorotron charger 3. A laser beam emitted from laser beam scanner 4 irradiates the surface of the photosensitive drum 1 so as to form an electrostatic latent image thereon.

The electrostatic latent image formed on the surface of the photosensitive drum 1 is developed by liquid developing unit 2 using a liquid developer. The rotational speed of developing roller 21 was set at 60 cm/sec, and the rotational speed of photosensitive drum 1 was set at 50 cm/sec. Developing roller 21 was rotated in the opposite direction (arrow b direction in the drawing) relative to the direction of rotation of photosensitive drum 1.

Thereafter, the excess liquid developer adhered to the surface of photosensitive drum 1 was removed by squeeze device 5, such that a toner image is formed in a state containing some liquid on the surface of photosensitive drum 1. The toner image is transported in conjunction with the rotation of photosensitive drum 1 to a transfer position opposite transfer roller 6, and comes into contact with a paper sheet transported from paper supply device 11, and is transferred to the paper sheet via an electrostatic transfer. A voltage of about −1,000 V was applied to transfer roller 6.

After the transfer sheet is separated from photosensitive drum 1, it is transported to the pair of fixing rollers 7, which fuse the toner image onto the transfer sheet via heat and pressure, whereupon the transfer sheet is ejected to discharge tray 12 and the image formation of 1 sheet is completed. Thereafter, the residual liquid developer remaining on the surface of photosensitive drum 1 is removed by cleaning device 10 in preparation for a subsequent image forming process.

The specific methods of evaluating the images are described below.

Line images 20 μm in width were formed on a transfer sheet at the beginning of use of the liquid developer, and the resulting line width was measured by optical microscope. Evaluation were based on the following criteria. The symbols ○ and Δ are passing.

○: Post-development line width greater than 20 μm but less than 22 μm

Δ: Post-development line width is greater than 22 μm but less than 24μm

X: Post-development line width is greater than 24 μm but less than 28 μm

X X: Post-development line width 28 μm or greater

A solid image was formed on a transfer sheet when a liquid developer was initially used, then a test sheet having a black-to-white (B/W) ratio of 5% was used as a sample image make1,000 repeated image formations, then the solid image was again formed on a transfer sheet. The image densities of the solid image formed when the developer was initially used and the solid image formed after 1,000 image formations were measured using a Sakura image densitometer (model TDA-65; Konica, Ltd.) The rate of change of image density was calculated and evaluated by the following criteria. The symbols ○ and Δ are passing.

○: Density change less than 10%

Δ: Density change 10% or greater but less than 15%

X: Density change 15% or greater but less than 30%

X X: Density change 30% or greater

Evaluation results are shown in Table 1.

TABLE 1

| | Mean particle size (μm) | Resolution | Initial I.D. | After use I.D. | I.D. rate of change |
|---|---|---|---|---|---|
| Example 1 | 1.81 | ○ | 2.2 | 2.2 | ○ |
| Example 2 | 2.16 | ○ | 2.0 | 1.8 | Δ |
| Example 3 | 2.24 | ○ | 2.1 | 1.8 | Δ |
| Ref Ex. 1 | 1.79 | xx | — | — | xx |
| Ref Ex. 2 | 1.79 | x | 1.8 | 1.8 | ○ |
| Ref Ex. 3 | 2.88 | Δ | 2.2 | 1.3 | xx |
| Ref Ex. 4 | 2.37 | Δ | 2.1 | 1.5 | x |

As can be understood from Table 1, the toners of Examples 1, 2, and 3 have an adequate particle size, and are capable of high resolution printing without loss of chargeability because no material is used other than the component material of the liquid developer during the production process. Since image density did not change, the characteristics of the developers during use exhibited virtually no change.

Although the liquid developer of Reference Example 1 had a particle size distribution similar to that of Example 1, the aqueous surfactant used in the granulation process remained in the liquid developer and is believed to have impaired the toner charging characteristics, causing the images to drift from initial use and resulting in only poor resolution images.

Although the liquid developer of Reference Example 2 exhibited some improvement of developing characteristics due to the washing process, the improvement was nevertheless unsatisfactory. Furthermore, the washing process required overnight washing, and the filtering process likewise required a long time to complete.

The liquid developers of Reference Examples 3 and 4 exhibited passing levels for resolution initially, after resistance printing the image density was markedly reduced, and the cause is thought to have been the change of the components of the liquid developers in conjunction with repeated image formation due to the broad particle size distributions.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A method for producing a liquid developer comprising steps of:

adding a colored resin to a nonpolar dispersion medium;

elevating the temperature of said nonpolar dispersion medium above the melting point of said resin;

producing a resin emulsion by mixing said heated nonpolar dispersion medium including said resin therein;

cooling said resin emulsion so as to obtain colored resin microparticles; and preparing a liquid developer by using the obtained colored resin microparticles.

2. The method as claimed in claim 1 wherein said liquid developer preparing step includes a step of adding a second nonpolar dispersion medium, which has the same composition or homologous properties as said non-polar dispersion medium, into said non-polar dispersion medium.

3. The method as claimed in claim 1 which further comprises a step of adding an oil-soluble surfactant into the nonpolar dispersion medium or the second non-polar dispersion medium.

4. The method as claimed in claim 3 wherein said oil-soluble surfactant comprises a chargeable material.

5. The method as claimed in claim 1 wherein said colored resin contains a pigment.

6. The method as claimed in claim 5 wherein said colored resin is obtained by mixing a resin and a pigment.

7. The method as claimed in claim 1 which further comprises a step of melting said colored resin in advance of the colored resin adding step.

8. A liquid developer produced by a process comprising steps of:

adding a colored resin to a nonpolar dispersion medium;

elevating the temperature of said nonpolar dispersion medium above the melting point of said resin;

producing a resin emulsion by mixing said heated nonpolar dispersion medium to which said resin has been added;

solidifying colored resin microparticles by cooling said resin emulsion, and preparing a liquid developer by using the obtained resin microparticles.

9. The liquid developer as claimed in claim 8 wherein said colored resin microparticles have an average volume size of 1.5 to 5.0 μm.

10. A method for producing a toner for a liquid developer comprising steps of:

adding a colored resin to a nonpolar dispersion medium;

elevating the temperature of said nonpolar dispersion medium above the melting point of said resin;

producing a resin emulsion by mixing said heated nonpolar dispersion medium to which said resin has been added; and solidifying colored resin microparticles by cooling said resin emulsion.

11. The method as claimed in claim 10 wherein said nonpolar dispersion medium comprises an electrically insulative organic compound.

12. The method as claimed in claim 10 which further comprises a step of adding an oil-soluble surfactant into said nonpolar dispersion medium.

13. The method as claimed in claim 12 wherein said oil-soluble surfactant comprises chargeable material.

14. The method as claimed in claim 10 wherein said colored resin contains a pigment.

15. The method as claimed in Claim 10 wherein said colored resin microparticles have an average volume size of 1.5 to 5.0 μm.

* * * * *

UNITED STATES PATENT AND TRADEMARK OFFICE

CERTIFICATE OF CORRECTION

PATENT NO. : 5,780,196

DATED : July 14, 1998

INVENTOR(S) : FUJIWARA et al.

It is certified that error appears in the above-identified patent and that said Letters Patent is hereby corrected as shown below:

On the title page item [75], should read:

--Toshimitsu Fujiwara, Hyogo-Ken; Shuji Iino, Kyoto; Masaharu Kanazawa, Osaka; Seishi Ojima; Hidetoshi Miyamoto, both of Osaka, all of Japan--

Signed and Sealed this

Sixth Day of October, 1998

Bruce Lehman

*Attest:*

BRUCE LEHMAN

*Attesting Officer*

*Commissioner of Patents and Trademarks*